US006417438B1

(12) United States Patent
Haruyama et al.

(10) Patent No.: US 6,417,438 B1
(45) **Date of Patent: *Jul. 9, 2002**

(54) APPARATUS FOR AND METHOD OF PROVIDING A PERFORMANCE GUIDE DISPLAY TO ASSIST IN A MANUAL PERFORMANCE OF AN ELECTRONIC MUSICAL APPARATUS IN A SELECTED MUSICAL KEY

(75) Inventors: Kazuo Haruyama; Takeo Shibukawa, both of Hamamatsu (JP)

(73) Assignee: Yamaha Corporation, Hamamatsu (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 19 days.

(21) Appl. No.: 09/452,601

(22) Filed: Dec. 1, 1999

(30) Foreign Application Priority Data

Sep. 12, 1998 (JP) ..... 10-350503

(51) Int. Cl.[7] ..... G10H 1/02
(52) U.S. Cl. ..... 84/619; 84/657
(58) Field of Search ..... 84/610–614, 619, 84/634–638, 650–652, 657, 666–669, 685, 712–717, 445–449

(56) References Cited

U.S. PATENT DOCUMENTS 4,941,387 A * 7/1990 Williams et al. ..... 84/619 X
5,477,003 A * 12/1995 Muraki et al. ..... 84/619 X
5,612,501 A * 3/1997 Kondo et al. ..... 84/619 X
5,864,079 A * 1/1999 Matsuda ..... 84/619

FOREIGN PATENT DOCUMENTS

| | | |
|---|---|---|
| JP | 2-22387 | 5/1990 |
| JP | 4-36388 | 6/1992 |
| JP | 07-044162 | 2/1995 |
| JP | 09-044161 | 2/1997 |
| JP | 10-198371 | 7/1998 |

* cited by examiner

*Primary Examiner*—Stanley J. Witkowski
(74) *Attorney, Agent, or Firm*—Pillsbury Winthrop LLP

(57) ABSTRACT

In addition to a general transposition setting device for setting a transposition for an entire musical instrument, there is provide an automatic-performance transposition setting device for optionally setting a transposition value for automatic performance. Automatic performance data is transposed in accordance with the transposition value set by the automatic-performance transposition setting device and a visual performance guide display based on the transposed automatic performance data is provided via a key display as an automatic performance process is advanced on a desired music piece. Human player depresses keys in accordance with the visual performance guide display so that tones corresponding to the depressed keys are generated. The transposition set via the automatic-performance transposition setting device does not act on the tones manually performed by the player's key depression operation, and only the transposition set via the general transposition setting device becomes effective on such manually-performed tones.

15 Claims, 8 Drawing Sheets

MAIN ROUTINE (2)

APPARATUS FOR AND METHOD OF PROVIDING A PERFORMANCE GUIDE DISPLAY TO ASSIST IN A MANUAL PERFORMANCE OF AN ELECTRONIC MUSICAL APPARATUS IN A SELECTED MUSICAL KEY

BACKGROUND OF THE INVENTION

The present invention relates to apparatus for and methods of providing a visual performance guide display to assist in a manual performance, and more particularly to an apparatus and method which, in an automatic performance device of electronic musical instruments etc., visually indicate keys to be depressed as a music performance progresses in accordance with prestored automatic performance data.

Electronic musical instruments equipped with a performance assisting function (hereinafter also called performance-assisting electronic musical instruments) have been known, where a plurality of LEDs are provided near and in corresponding relation to individual keys so that particular LEDs associated with the keys corresponding to tone pitch data (key numbers) contained in automatic performance data are sequentially turned on or illuminated in accordance with progression of a background automatic performance to visually guide a human player in a manual performance. However, the performance-assisting electronic musical instruments so far proposed can set only one transposition for the entire tone data processing system thereof, and thus they always apply a same or common transposition to both the manual performance on the keyboard and the automatic performance. Because only the same transposition is applied to both the manual performance on the keyboard and the automatic performance, the LEDs to be illuminated for a visual key depression guide need not differ between the manual performance and the automatic performance and the LEDs to be illuminated after the transposition are the same as those before the transposition. For this reason, the conventional performance-assisting electronic musical instruments only permit practice on a keyboard performance corresponding only to a particular musical key of the automatic performance data. Thus, when a user desires to practice a keyboard performance corresponding to a different musical key than that of the automatic performance data (i.e., when the user desires to practice a keyboard performance with the different musical key just as with a natural musical instrument such as a piano), there arises a need to edit the pre-recorded automatic performance data so as to conform to the different or user-desired key, and the editing operations are very cumbersome and time-consuming.

Pre-recording automatic performance data corresponding to a variety of musical keys may be one possible approach to practice on a keyboard performance corresponding to a desired musical key other than that of the automatic performance data. However, with this approach, many sets of automatic performance data have to be pre-recorded per music piece in correspondence with the various musical keys, which would unavoidably waste data storage areas of limited capacity.

SUMMARY OF THE INVENTION

It is therefore an object of the present invention to provide an apparatus and method which, in an application where keys to be depressed are guided in accordance with progression of a music piece performed automatically or otherwise, e.g., where keys to be depressed are visually indicated by illuminating LEDs located near the keys in corresponding relation thereto, permit appropriate illumination of the keys in correspondence with any transposition applied to the music piece.

In order to accomplish the above-mentioned object, the present invention provides a performance assisting apparatus for receiving automatic performance data and causing a performance guide device to provide a guide to a manual performance on the basis of the received automatic performance data, which comprise: a transposition setting device adapted to set a transposition value for the automatic performance data; and a processor coupled with the transposition setting device and the performance guide device, the processor being adapted to transpose the automatic performance data in accordance with the transposition value set by the transposition setting device and cause the performance guide device to provide a performance guide based on the transposed automatic performance data. In the performance assisting apparatus, the transposition value set by the transposition setting device is prevented from becoming effective or acting on a tone based on the manual performance.

According to the present invention thus arranged, the tone pitch designated by the automatic performance data is transposed (converted from one musical key to another) in accordance with the transposition value set by the transposition setting device, and the thus-transposed tone pitch is visually indicated by the performance guide device. Thus, by a human player manually operating particular ones of the performance operators on the keyboard as visually indicated by the performance guide device, there is achieved a manual performance with player's operation corresponding to the transposition of the automatic performance data. Here, because the transposition value set by the transposition setting device is caused to not become effective or act on each tone based on the manual performance, the manually-performed tone is sounded with a pitch exactly as operated by the player (namely, the manually-performed tone is prevented from being automatically transposed), when a manual performance is executed with the operation corresponding to the transposition of the automatic performance data manipulation based on the transposition of the automatic performance data. This arrangement achieves a performance free of inconveniences. Namely, the present invention, on the basis of automatic performance data of a single music piece, permits a visual performance guide corresponding to any optional transposition of the automatic performance data. More specifically, the present invention achieves a performance assisting apparatus which can appropriately deal with a variety of transposition with utmost ease (i.e., time and labor involved in editing can be minimized because it is only necessary to set a transposition value by means of the transposition setting device) and a simplified structure and without a need to edit and store many sets of the automatic performance data of the single music piece in correspondence with different musical keys.

Further, according to another aspect of the present invention, there is provided a music performance apparatus which comprises: a plurality of performance operators corresponding to a plurality of tone pitches; a performance guide device adapted to provide a performance guide display for indicating which of the performance operators is to be operated; a performance data supplying device adapted to supply performance data of an optionally selected music piece, the performance data containing at least tone pitch information; a transposition setting device adapted to set a transposition value for the performance data; a processor coupled with at least the performance guide device, the performance supplying device and the transposition setting device, the processor being adapted to transpose the performance data by controlling the tone pitch information in accordance with the transposition value set by the transposition setting device and cause the performance guide device to provide the performance guide display based on the controlled tone pitch information; and a tone generator device adapted to generate a tone at least in response to operation of any of the performance operators. In the music performance apparatus, the transposition value set by the transposition setting device is not applied to a tone that is to be generated via the tone generator device in response to the operation of the performance operator. In this case, a desired transposition can be imparted only to the performance guide display in the same manner as mentioned above, so that the same advantageous benefits and objects as above are achieved.

The music performance apparatus may further comprise a general transposition setting device adapted to set a general transposition value, and the pitch of the tone to be generated via the tone generator device in response to the operation of the performance operator may be controlled in accordance with the general transposition value set by the general transposition setting device. With this arrangement, it is only necessary that a desired transposition amount, with which the player wants to practice using the performance guide function, be set directly by the transposition setting device for the performance data, which greatly simplifies the necessary setting operations and makes it very easy to determine an amount or degree of transposition that should be set for a manual performance assisted by the performance guide function. Then, if an automatic performance tone corresponding to the performance data is to be generated, it is desirable that the transposition by the general transposition setting device act on the automatic performance tone. This is because the tone manually performed in accordance with the performance guide display is transposed by the general transposition setting device and hence it is desirable to transpose the automatic performance tone in conformity with the transposed manually-performed tone. Therefore, in this case, the pitch of the automatic performance tone is better controlled in accordance with a combination of the transposition values set by both the transposition setting device for the performance data and the general transposition setting device.

It should be noted that the terms "manual performance" as used in the context of the present invention refer not only to a form of performance executed by operating performance operators of a keyboard or the like with a human player's hand but also to other forms of performance executed using a player's foot or other part of his or her body.

The present invention may be implemented not only as the apparatus invention but also as a method invention. The present invention may also be practiced as a program for execution by a processor, such as a CPU or DSP, and as a medium storing such a program.

BRIEF DESCRIPTION OF THE DRAWINGS

For better understanding of the object and other features of the present invention, its preferred embodiments will be described in greater detail hereinbelow with reference to the accompanying drawings, in which.

DETAILED DESCRIPTION OF THE PREFERRED EMBODIMENTS

One preferred embodiment of the present invention will be described in detail as applied to an automatic performance in an electronic musical instrument. Note that the preferred embodiment described here is just illustrative and may of course be variously modified without departing from the spirit of the present invention.

[Hardware Setup]

Figure 1:
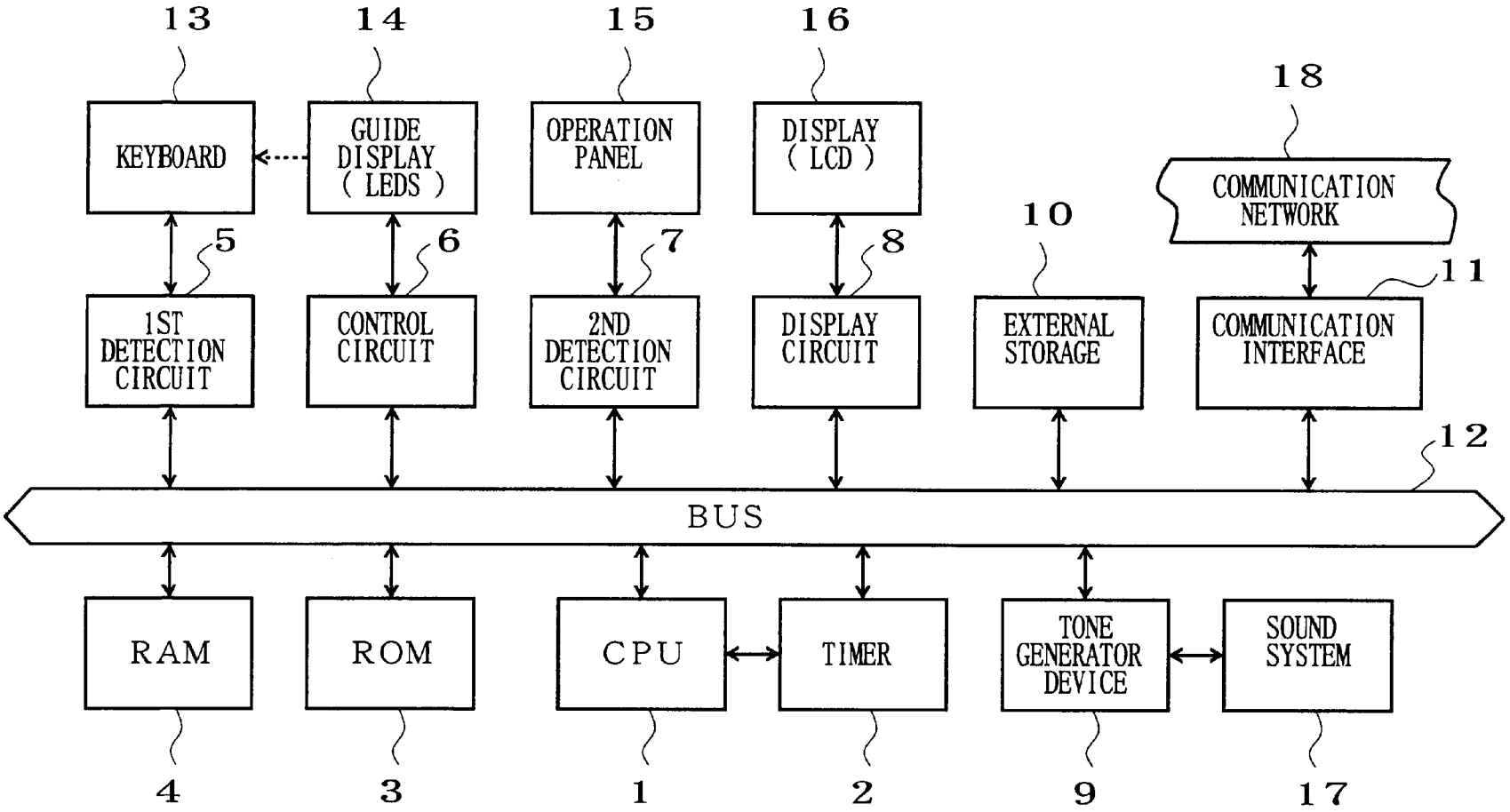
FIG. 1 is a block diagram showing a general hardware setup of a performance assisting apparatus in accordance with a preferred embodiment of the present invention.

Referring first to FIG. 1, there is shown in block diagram a general hardware setup of a performance assisting apparatus in accordance with the preferred embodiment of the present invention. The performance assisting apparatus of FIG. 1 includes a central processing unit (CPU) 1, a timer 2, a read-only memory (ROM) 3, a random access memory (RAM) 4, a first detection circuit 5, a performance guide control circuit 6, a second detection circuit 7, a display circuit 8, a tone generator device 9, an external storage device 10 and a communication interface 11, which are connected with each other via a bus 12.

The CPU 1 for controlling overall operation of the performance assisting apparatus is connected with the timer 2 that generates tempo clock pulses to be used for various interrupt processes, and the CPU 1 performs various control in accordance with predetermined programs. In particular, the CPU 1 carries out a performance assisting or performance guide function as will be later described in detail. In the ROM 3, there are prestored predetermined control programs for controlling the performance assisting apparatus, which may include various processing programs pertaining to the inventive performance assistance as well as a fundamental performance information processing program. The ROM 3 may also have prestored therein song data related to the performance assistance. The RAM 4 is used as a PANEL buffer for storing various setting various parameters necessary for the processes, other buffers such as a SONG buffer SB, and working areas for temporarily storing a RUN flag, a GUIDE flag, etc.

Keyboard 13 connected to the first detection circuit 5 has, for example, a total of 88 keys which are initially set to tone pitches "A0" to "C8" in a left-to-right direction of the keyboard; that is, the leftmost key on the keyboard 13 is initially set to tone pitch "A0" and the rightmost key set to tone pitch "C8". The performance guide control circuit 6 controls a guide display device 14 on the basis of LED ON/OFF instructions. The guide display device 14 includes, for example, a total of 88 LEDs (Light Emitting Diodes) that are positioned near and in corresponding relation to the keys of the keyboard 13.

Operation panel 15 and a display 16, such as a liquid crystal display, are connected to the second detection circuit 7 and display circuit 8, respectively, and a sound system 17 including an amplifier and a speaker is connected to the tone generator device 9 so as to audibly reproduce tones based on manipulation of the keyboard 13 and automatic performance data. For various operations and processes of the performance assisting apparatus of the present invention, the operation panel 15 includes tone color setting switches, numeric keypads usable for setting values of "panel transposition" and "song transposition", respectively, "INCREMENT/DECREMENT" switches also usable for setting values of the panel transposition and song transposition, reset switches for the panel transposition and song transposition, automatic performance start/end switch, performance guide function ON/OFF switch. With this operation panel 15 thus arranged, a user or human operator (or player) can perform various input operations for purposes of instructions, selection and data entry. The display 16 is employed to display various visual information, such as a name of a song being automatically performed, in order to assist the player in operating the performance assisting apparatus. The display 16 is provided on or in the operation panel 15 along with the switches. Note that the input functions of the various switches of the operation panel 15 may be implemented by various function buttons shown on the screen of the display 16.

The external storage device 10 may comprise one or more of various conventional storage devices, such as a hard disk device (HDD), compact-disk read-only-memory (CD-ROM), magneto optical (MO) disk drive, digital versatile disk (DVD) drive, etc. Storage media in the external storage device 10 can store therein programs, tables, data, etc. that are necessary for the performance assisting processing of the present invention. Further, various performance data can be stored in the media in, for example, the known MIDI (Musical Instrument Digital Interface) format.

The performance system of the above-mentioned components 1–17 may take the form of an electronic musical instrument or automatic performance device, or the form of application software installed in a personal computer with a tone generator incorporated therein. Such application software may be stored in a medium of the external storage device, such as a magnetic disk, optical disk or a semiconductor memory, and may be supplied from the medium to the personal computer. The performance system is also applicable to performance assisting equipment employed in a karaoke device. Further, in the performance system of the present invention, the communication interface 11 is connected to the bus 12, so that the system can communicate with a desired server computer (not shown) via a communication network 18.

In relation to the performance system of the present invention, a brief description is made here about a case where the hard disk device or CD-ROM drive is used as the external storage device 10. The hard disk device (HDD) is a device for storing control programs and various data. Where the control programs are not prestored in the ROM, the control programs may be prestored in the hard disk within the hard disk device and then read into the RAM; this way, the CPU is allowed to operate in much the same way as where the control programs are prestored in the ROM. This arrangement greatly facilitates version-upgrade of the control programs, addition of a new control program, etc. Further, the CD-ROM drive is a device for reading out control programs or various data stored in a detachable CD-ROM. The read-out control programs or various data can be stored into the hard disk within the hard disk device, which thus greatly facilitates version-upgrade of the control programs, addition of a new control program, etc.

Brief description is also made here about a case where the necessary programs are downloaded via the communication network 18 connected with the communication interface 11. Specifically, the communication interface 11 is connected to the communication network 18, such as a LAN (Local Area Network), the Internet or telephone network, by way of which it is connected with a desired sever computer. Thus, in the case where a desired one of the control programs and/or desired data is not prestored in the ROM 3 or hard disk device, the communication interface 11 is used to download the program and/or data from the server computer. In such a situation, the performance system of the invention, as a "client", sends a command to request the server computer to download the program and/or data by way of the communication interface 11 and communication network 18. In response to the command, the server computer delivers the requested program and/or data to the system via the communication network 18. The system receives the program and/or data via the communication interface 11 and stores them into the hard disk device 10 or the like. In this way, the necessary downloading of the program and/or data is completed.

[Various Data]

Figure 2:
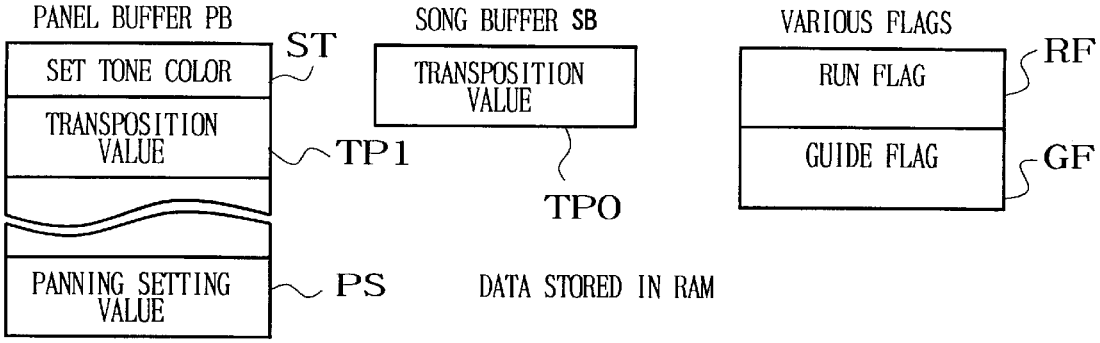
FIG. 2 is a diagram showing an exemplary format of data stored in a RAM of FIG. 1.
Figure 3:
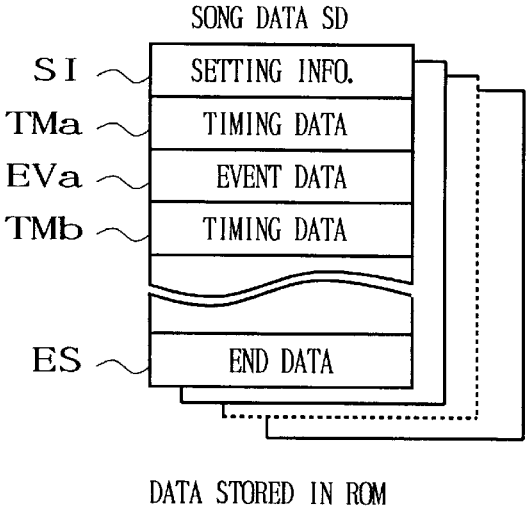
FIG. 3 is a diagram showing an exemplary format of song data stored in a ROM of FIG. 1.

FIGS. 2 and 3 show exemplary formats of data stored in the RAM 4 and ROM 3 which are used in the performance assisting processing by the performance assisting apparatus in accordance with the preferred embodiment. In the illustrated example, the song data SD stored in the ROM 3 are one-track automatic performance data having only a melody track. The song data SD, as shown in FIG. 3, comprise a time series of various setting information Si indicative of a tone color, performance tempo and the like with which the song data SD are to be reproduced and pairs of timing data TMa, TMb, . . . and event data EVa, EVb, . . . following the setting information S1. The song data SD end with song end data ES.

In the RAM 4, as shown in FIG. 2, there are provided the PANEL buffer PB, SONG buffer SB and various flags. The PANEL buffer PB is provided for storing current settings for the entire tone generating system in the electronic musical instrument; specifically, the PANEL buffer PB stores a tone color ST, transposition value TP1, . . . , panning value PS, etc, which are currently set on the operation panel 15. The transposition value TP1 for the entire electronic musical instrument can be set by operating the numeric keypad for panel transposition and/or INCREMENT/DECREMENT switch and acts on a tone generation process responsive to key depression on the keyboard 13. For an automatic performance process as well, the transposition value TP1, along with a later-described song transposition value TP0, acts on tone generation/tone deadening (silencing) of automatic performance data.

The SONG buffer SB is a buffer for storing a currently-set transposition value TP0 only for the song data SD to be reproduced for an automatic performance. The song transposition value TP0 for automatically-performed music piece can be set by operating the numeric key pad for song transposition and/or INCREMENT/DECREMENT switch and acts on the automatic performance process and an LED illumination process for turning on/off the LEDs. Note that these transposition values TP1 and TP0 are each an integral value whose minimum unit represents a half-step transposition; for example, transposition value "0" represents a zero transposition and transposition value "1" represents a unit variation amount of "+1", i.e, a halfstep transposition. Of course, the same numeric keypad, rather than the separate numeric keypads, may be used for both the panel transposition and the song transposition.

The RAM 4 stores the following flags. The RUN flag RF indicates whether or not an automatic performance is being currently carried out. When the RUN flag RF is at a value "1" (i.e., RUN=1), it is indicated that a music performance is being reproduced on the basis of the song data SD stored in the ROM 3, in which case the automatic performance process is permitted for tone generation/tone deadening based on the event information TMa, EVa; TMb, EVb; . . . contained in the song data SD. When the RUN flag RF at a value "0" (i.e., RUN=0), it is indicated that no music performance is being reproduced, in which case the automatic performance process is not carried out.

The GUIDE flag GF indicates whether or not the performance guide is being currently provided via the LEDs of the guide display device 14. When the GUIDE flag GF is at a value "1" (i.e., GUIDE=1), it is indicated that the performance guide is being currently provided to sequentially turn on the LEDs corresponding to the keys to be depressed and turn off the LEDs corresponding to the keys to be released in accordance with an automatic performance of the song data SD; however, the tone generation/tone deadening process based on the event information of the song data is not carried out. The tone generation/tone deadening process is made effective when the GUIDE flag GF is at a value "0" (i.e., GUIDE=0) indicating that the performance guide is not being currently provided.

Figure 4:
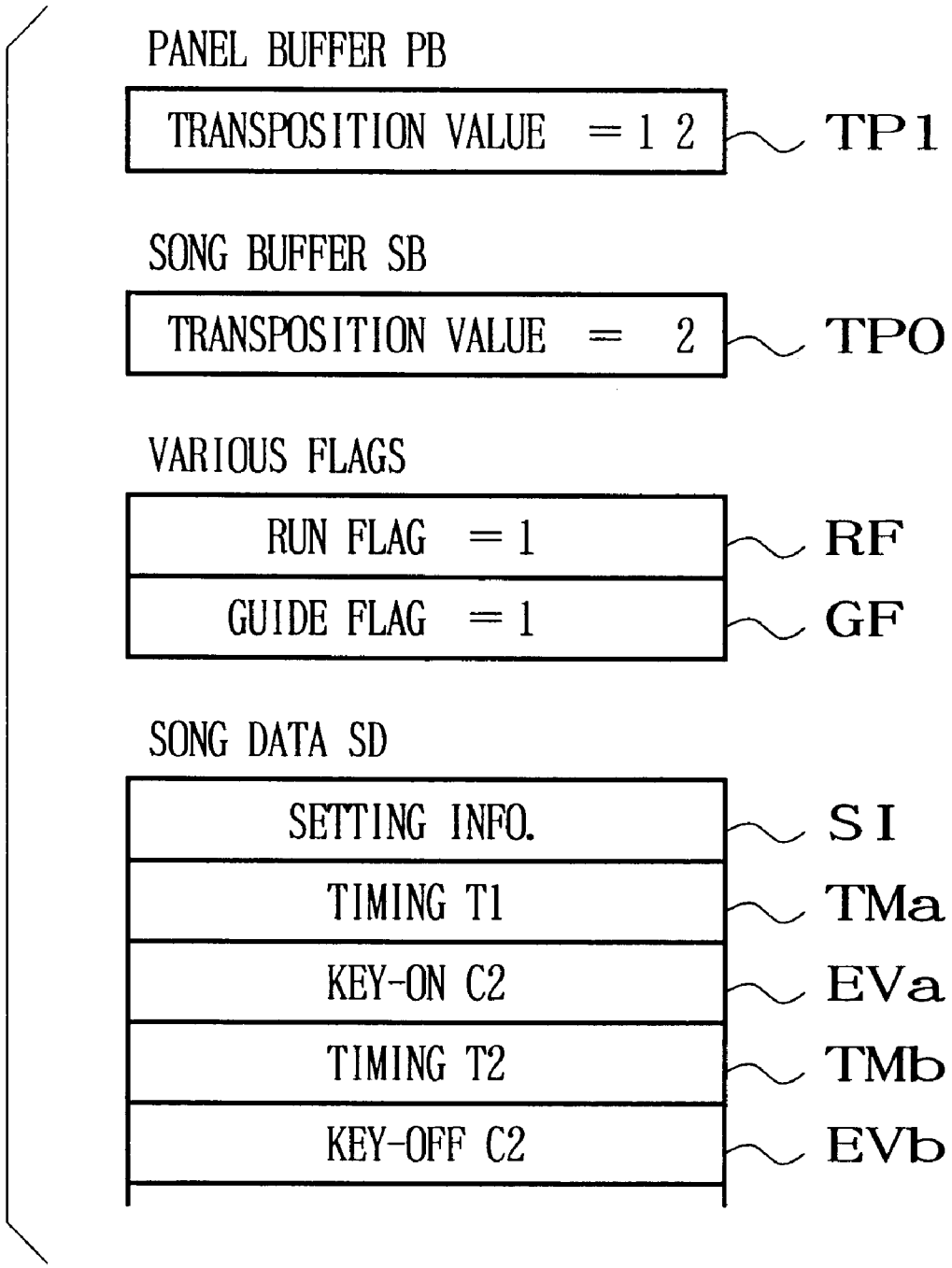
FIG. 4 is a diagram showing exemplary details of various data employed in the embodiment of FIG. 1.

FIG. 4 shows exemplary details of the individual data mentioned above. In this figure, the song data SD to be automatically performed is shown as being of C major key, and it is assumed that a user desires to practice performing on the keyboard with the song data SD transposed to D major and the entire electronic musical instrument transposed one octave higher than the initial setting. In such a case, it is only necessary for the user to set the song transposition value TP0 to "2" and the panel transposition value TP1 to "12" by operating the respective numeric keypads (which, as stated above, may be one and the same numeric keypad) and INCREMENT/DECREMENT switch. Because the RUN flag is at the value "1" (RUN=1) and the GUIDE flag is at the value "1" (GUIDE=1), the electronic musical instrument according to the illustrated example is in a condition where the automatic performance and performance guide functions are being carried out by activation of the automatic performance start switch and performance guide ON/OFF switch.

[Concepts of Performance Assistance]

Figure 5:
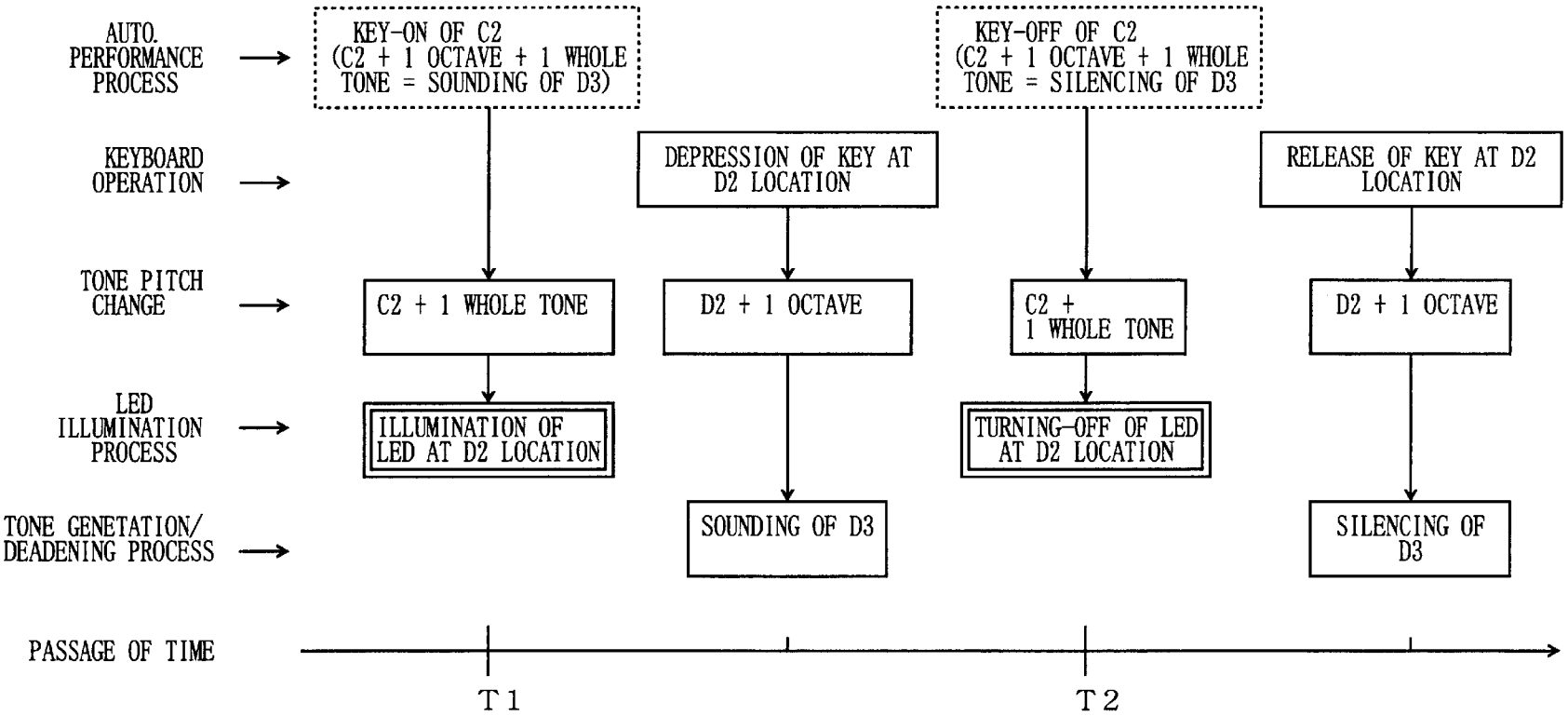
FIG. 5 is a diagram explanatory of basic concepts of the performance assistance.

FIG. 5 is a diagram explaining the basic concepts of the performance assistance of the present invention in relation to the above-described arrangements. Let's assume that according to the event information of the song data SD, the "C2" key is turned on at a time point T1 and turned off at a time point T2. Note that whether or not the tone generation/tone deadening in the automatic performance process is actually reflected in a tone reproduced through the sound system 17 depends on the set value of the GUIDE flag GF. The panel transposition value TP1 is "12" and the song transposition value TP0 is "2" in this case, so that once key-on data of "C2" is read out at the time point T1 from among the automatic performance song data SD, the automatic performance process will be carried out to generate a tone of "D3" that is higher than the key-on data of "C2" by "12+2", i.e., "one octave + a whole tone (whole step)", if the GUIDE flag is at the value "0".

However, because the GUIDE flag is at the value "1" in this case as seen from FIG. 4, a tone pitch change of "+2", i.e., "+ one whole tone", is made due to the panel transposition value TP0 of "2", and thus one of the LEDs is turned on or illuminated which corresponds to the key at the "D2" location, namely, the 18th white key from the leftmost key based on the initial setting. Then, once the user depresses the "D2" key, in accordance with the visual guide by the illuminated LED, at a time point slightly later than the time point T1 (i.e., slightly after the illumination of the LED) as shown in FIG. 5, a tone pitch change of "+12", i.e., "+ one octave", is made due to the panel transposition value TP1 of "12" and a tone of "D3" is generated in response to depression of the key at the "D2" location.

Thus, in the case where are made settings corresponding to a "performance practice in D major with the entire keyboard transposed one octave higher than the original" as in the case of FIG. 4, the key of "D2" in the D major performance is indicated as the key corresponding to the tone pitch of "C2" originally recorded within the song data SD, and a tone of "D3", taking into account the transposition value for the entire keyboard, is generated in response to depression of the key at the indicated location.

Similar operations take place for a key-off event. Namely, in response to key-off data of "C2" read out from among the song data SD at the time point T2, the automatic performance process is carried out to silence a tone higher than "C2" by "12+2", i.e., "one octave + one whole tone", if the GUIDE flag is at the value "0" (GUIDE=0). However, if the GUIDE flag is at the value "1" (GUIDE=1) as in the case of FIG. 4, the LED corresponding to the "D2" key having been illuminated through the tone pitch change of "+2" (=+one whole tone) is turned off in the guide display device 14 at the time point T2 of FIG. 5. Once the user releases the "D2" key in accordance with the turning-off of the LED associated with the "D2" key, the tone of "D3" is silenced through a tone pitch change of "+12" (=+one octave).

[Main Routine]

Figure 6:
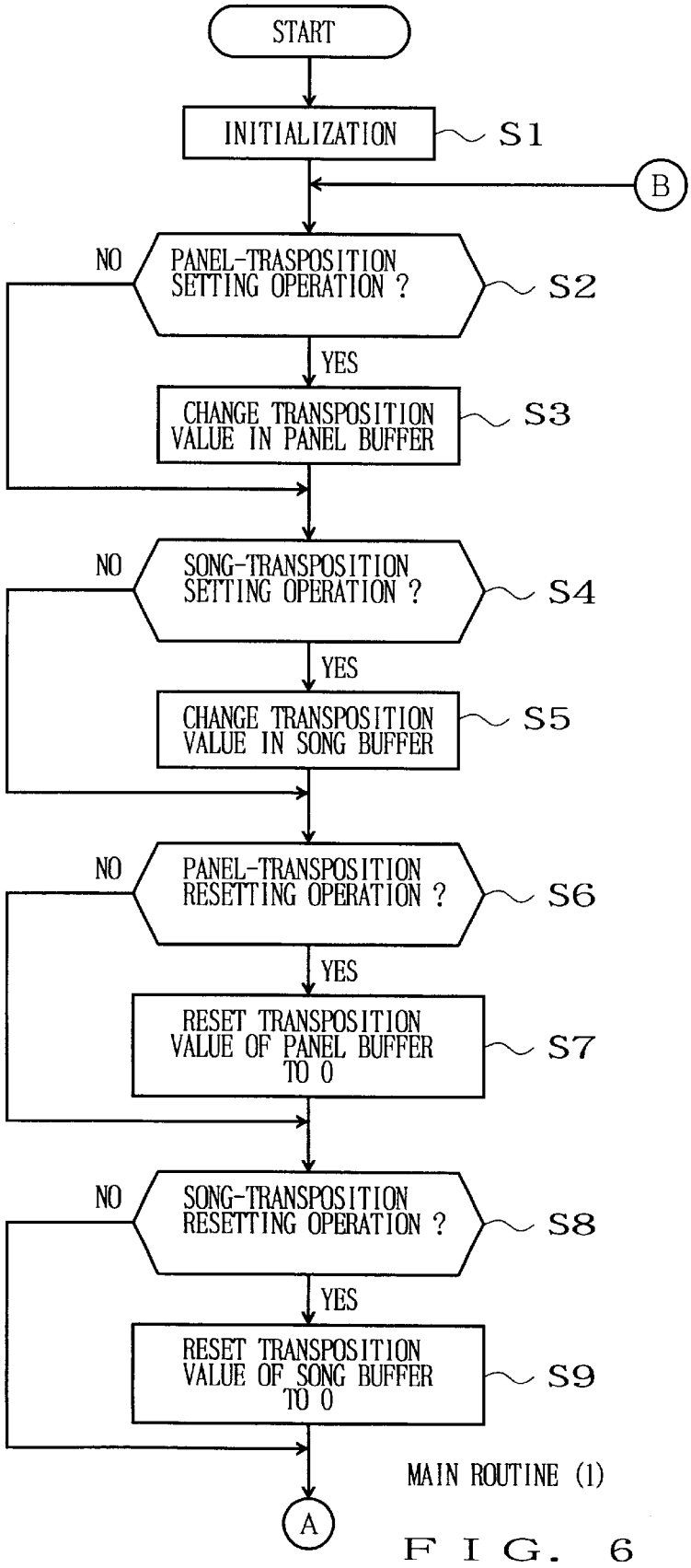
FIG. 6 is a flow chart showing part of an example of a main routine for the performance assistance carried out by the performance assisting apparatus of FIG. 1.
Figure 7:
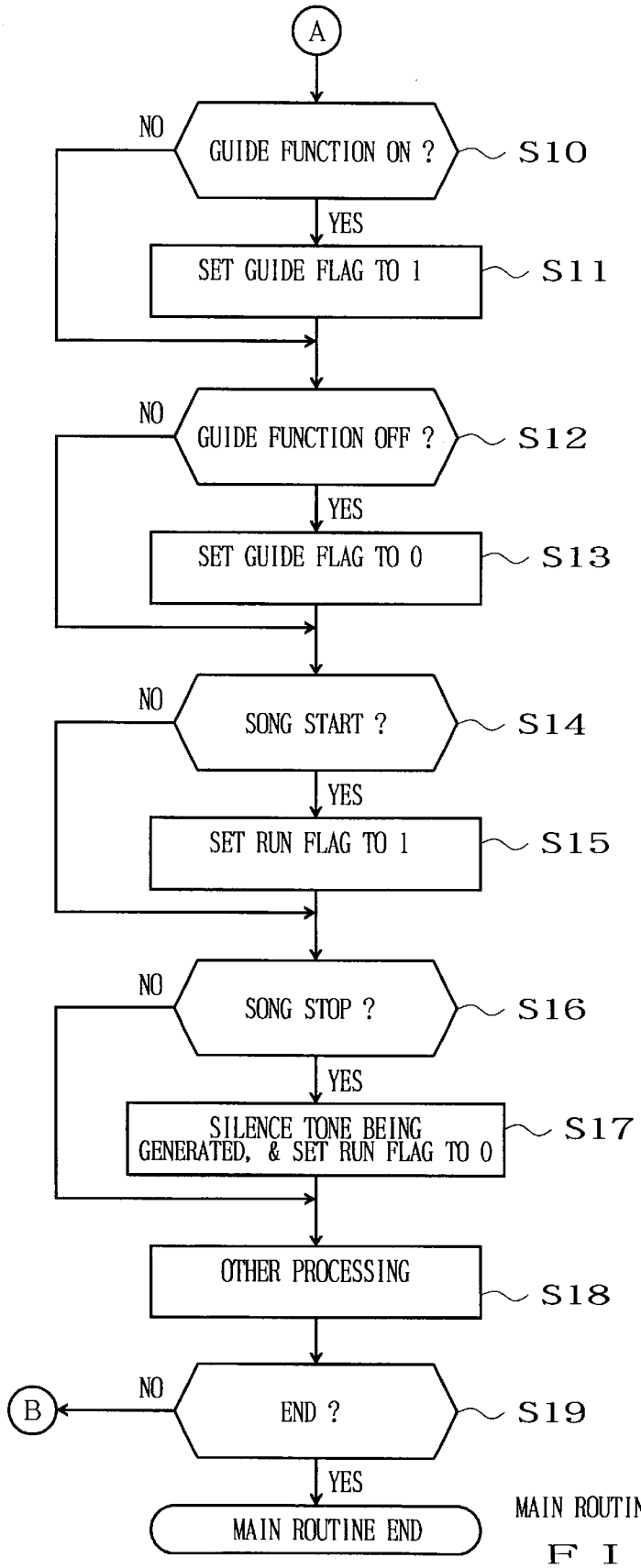
FIG. 7 is a flow chart showing the remaining part of the main routine.

FIGS. 6 and 7 are flow charts showing an example of a main routine for the performance assistance carried out by the performance assisting apparatus in accordance with the preferred embodiment. Upon power-on of the performance system, this main routine is activated, and a predetermined initialization process is conducted at step S1. Then, at step S2, a determination is made as to whether any panel-transposition setting operation has been performed. If answered in the affirmative (YES), the main routine moves on to step S3, where the transposition value TP1 stored in the PANEL buffer PB is changed to a value as set by the panel-transposition setting operation. Namely, the transposition value TP1 representing a transposition value for the entire electronic musical instrument is set through the operation of the numeric keypad for panel transposition and INCREMENT/DECREMENT switch and then stored into the PANEL buffer PB.

As will be described later, the PANEL transposition value TP1 is used to change the tone pitch designated by key depression on the keyboard 13 and automatic performance data. For example, where the PANEL transposition value TP1 is set to "12" with the song transposition value TP0 set to "0", depression of the key at the "C3" location generates a tone of "C4" (=C3+12) and key-on data of "C3" read out from among the automatic performance data is sounded as a tone of "C4" (=C3+0 +12).

After step S3 or if no panel-transposition setting operation has been performed as determined at step S2, it is further determined whether any song-transposition setting operation has been performed. If answered in the affirmative (YES), the main routine moves on to step S5 in order to change the transposition value TP0 stored in the SONG buffer SB to a value set via the operation panel 15 and then goes to step S6. If, however, no song-transposition setting operation has been performed as determined at step S4, the main routine goes directly to step S6, bypassing step S5. Namely, the song transposition value TP0 representing a transposition value for an automatically-performed music piece is set through the operation of the numeric keypad for song transposition and INCREMENT/DECREMENT switch and then stored into the SONG buffer SB.

As will be described later, the SONG transposition value TP0 is used to change the tone pitch designated by the automatic performance data and the LED to be illuminated. For example, where the song transposition value TP0 is set to "2" with the PANEL transposition value TP1 set to "12", the key-on data of "C3" read out from among the automatic performance data is sounded as a tone of "D4" (=C3+2 +12), but the LED corresponding to the key at location "D3" (=C3+2) is illuminated if the electronic musical instrument is in a performance guide mode.

Further, at step S6, a determination is made as to whether or not the panel-transposition reset switch has been operated on the operation panel 15. If the panel-transposition reset switch has been operated (YES determination), the main routine moves on to step S7 in order to reset the panel transposition value TP1 in the PANEL buffer PB and then goes to step S8. If, on the other hand, the panel-transposition reset switch has not been operated as determined at step S6, then the main routine goes directly to step S8, bypassing step S7. At step S8, a further determination is made as to whether or not the song-transposition reset switch has been operated on the operation panel 15. If the song-transposition reset switch has been operated (YES determination), the main routine moves on to step S9 in order to reset the song transposition value TP0 in the SONG buffer SB and then goes to step S10 of FIG. 10. If, on the other hand, the song-transposition reset switch has not been operated as determined at step S8, the main routine goes directly to step S10, bypassing step S9.

At step S10, a determination is made as to whether or not the performance guide ON/OFF switch has been operated on the operation panel 15 to activate the performance guide function. If answered in the affirmative (YES determination), the main routine moves on to step S11 in order to set the GUIDE flag GF to the value "1" and then goes to step S12. If, on the other hand, the performance guide ON/OFF switch has not been operated to activate the performance guide function as determined at step S10, the main routine goes directly to step S12, bypassing step S11. At step S12, a further determination is made as to whether or not the performance guide ON/OFF switch has been operated on the operation panel 15 to deactivate the performance guide function. If answered in the affirmative (YES determination), the main routine moves on to step S13 in order to set the GUIDE flag GF to the value "0" and then goes to step S14. If, on the other hand, the performance guide ON/OFF switch has not been operated to deactivate the performance guide function as determined at step S12, the main routine goes directly to step S14, bypassing step S13.

When the GUIDE flag is at the value "1" (GUIDE=1), the performance guide function becomes effective to turn on and off the LEDs corresponding to the keys to be depressed on the keyboard 13 in response to data readout from among the song data SD, as will be later described. According to the described embodiment of the present invention, while the performance guide function is effective or ON, the LED illumination process to turn on/off the LEDs is performed without the tone generation/tone deadening process corresponding to key-on and key-off data read out from among the song data SD being performed at all.

At step S14, a determination is made as to whether or not the automatic performance start switch has been operated on the operation panel 15 to start an automatic song performance. If answered in the affirmative (YES determination), the main routine moves on to step S15 in order to set the RUN flag RF to the value "1" and then goes to step S16. If, on the other hand, the automatic performance start switch has not been operated as determined at step S14, the main routine goes directly to step S16, bypassing step S15. At step S16, a further determination is made as to whether or not the automatic performance end switch has been operated on the operation panel 15 to stop an automatic song performance. If answered in the affirmative (YES determination), the main routine moves on to step S17 in order to set the RUN flag RF to the value "0" and then goes to step S18. If, on the other hand, the automatic performance end switch has not been operated as determined at step S16, the main routine goes directly to step S18, bypassing step S17.

At step S18, other processing is carried out, which includes processes to set a tone color and performance tempo and edit the song data. After step S18, it is determined at step S19 whether the main routine is to be terminated or not. With a negative answer, the main routine loops back to step S2; otherwise, the main routine is brought to an end.

[Key Depression/Release Process]

Figure 8:
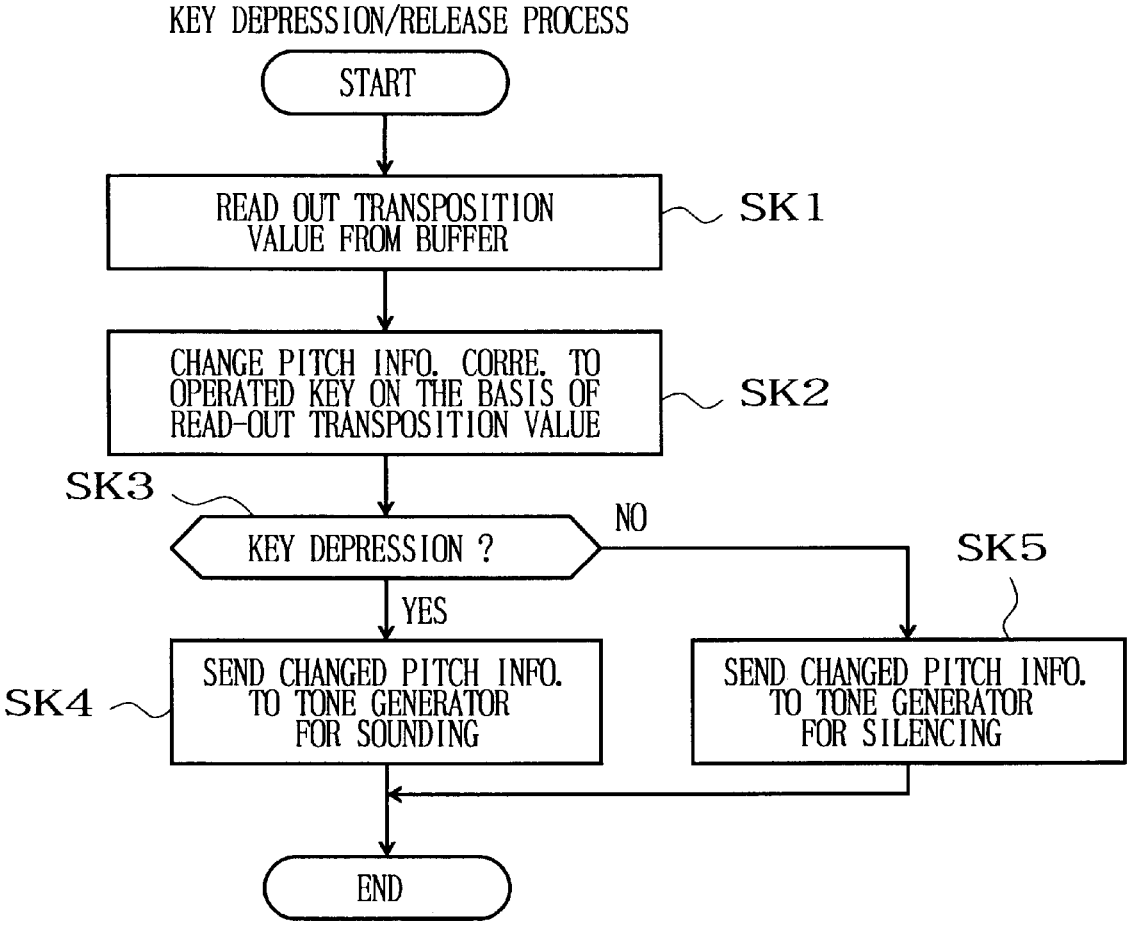
FIG. 8 is a flow chart of a key depression/release process that is interruptively carried out by the performance assisting apparatus of FIG. 1.

In FIG. 8, there is shown an exemplary operational flow of a key depression/release process that is interruptively carried out during a loop of the main routine each time a key operation (key depression or key release) occurs on the keyboard 13 during the main routine. At first step SK1 of this key depression/release process, the panel transposition value TP1 is read out from the PANEL buffer PB. Then, at step SK2, tone pitch information corresponding to the operated key is changed on the basis of the read-out panel transposition value TP1. Where the read-out panel transposition value TP1 is "12" as in the case of FIG. 4, then a tone pitch change amount of "+12" (=+one octave) is designated, so that the tone pitch information "D2" is changed to "D3" as shown in FIG. 5.

Determination is made at next step SK3 as to whether or not the detected key operation is a key depression operation, and the process goes to steps SK4 or SK5 depending on the determination result of step SK3. Namely, if the detected key operation is a key depression operation (YES determination), the process goes to step SK4 in order to send the tone pitch information, changed at step SK2, to the tone generator device 9, which, in turn, executes the tone generation process to generate a tone with the pitch designated by the tone pitch information. If, on the other hand, the detected key operation is a key release operation (NO determination), the process goes to step SK5 in order to send the changed tone pitch information to the tone generator device 9, which, in turn, executes the tone deadening process to silence the tone being generated with the pitch designated by the tone pitch information. Upon completion of the tone generation or deadening process, this key depression/release process is terminated.

[Automatic Performance Process]

Figure 9:
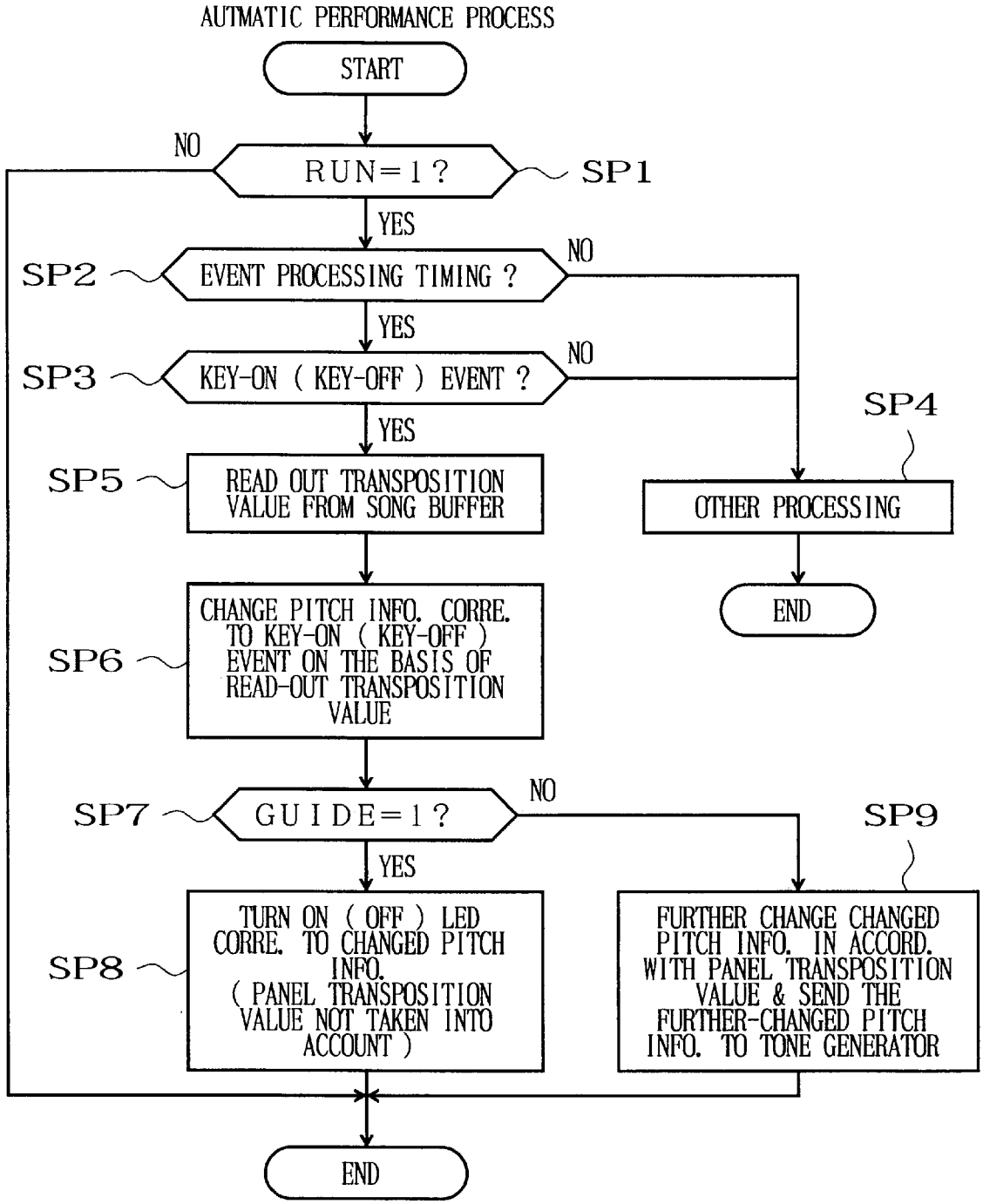
FIG. 9 is a flow chart of an automatic performance process carried out by the performance assisting apparatus of FIG. 1.

In FIG. 9, there is shown an exemplary operational flow of the automatic performance process that is carried out in parallel with the main routine; specifically, this automatic performance process is executed as an interrupt process in response to every clock pulse generated by the timer 2. Once the automatic performance process is activated, it is first determined at step SP1 whether or not the RUN flag is at the value "1". If answered in the negative (NO), the automatic performance process is terminated immediately without carrying out any other operations. If, on the other hand, the RUN flag is at the value "1" (YES), then a determination is made at next step SP2 whether predetermined time for processing the event information (event processing timing) of the song data SD has arrived or not, by ascertaining a coincidence between the count of the clock pulses generated by the timer and the timing data TMa, TMb, . . . of the song data SD. If the time for processing the event information (event processing timing) has arrived as determined at step SP2, the process proceeds to step SP3 in order to determine whether the event information represents a tone generation (key-on) event or a tone deadening or silencing (key-off) event.

If answered in the negative (NO) at step SP2 or SP3 (i.e., if the time for processing the event information has not arrived or the event information does not represents a tone generation or tone deadening event), the process branches to step SP4 in order to carry out other processing. More specifically, if the time for processing the event information has not arrived as determined at step SP2, the number of the clock pulses generated by the timer 2 is counted at step SP4, while if the event information doe not represent a tone generation event or a tone deadening event as determined at step SP3, other processing, such as an event process including tone volume change and pitch bend operations and readout of the next timing data. After the other processing of step SP4, the automatic performance process is terminated.

If, on the other hand, it has been determined whether the event information EVa, EVb, . . . represents a tone generation event or a tone deadening event as in the case of FIG. 4, then the process sequentially carries out operations of steps SP5-SP7 as follows. At step SP5, the song transposition value TP0 is read out from the SONG buffer SB. Then, at next step SP6, tone pitch information corresponding to the tone generation event or tone deadening event is changed on the basis of the read-out song transposition value TP0. Where the read-out song transposition value TP0 is "2" as in the case of FIG. 4, then a tone pitch change amount of "+2" (=+one whole tone) is designated, so that the tone pitch information "C2" is changed to "D2" as shown in FIG. 5.

At step SP7, it is further determined whether or not the GUIDE flag is at the value "1" (GUIDE=1). If so, the automatic performance process moves on to step SP8 in order to carry out the LED illumination process. If, on the other hand, the GUIDE flag is at the value "0", the tone generation/tone deadening process is performed on the automatic performance data at step SP9. Upon completion of the LED illumination process of step SP8 or the tone generation/tone deadening process of step SP9, the automatic performance process is terminated.

As noted earlier, the LED illumination process of step SP8 is intended to provide a visual performance, i.e., key depression, guide by turning on/off the LEDs of the guide display device 14. Specifically, at step SP8, the LED associated with the key corresponding to the tone pitch information changed at step SP6 is turned on or off. Namely, the turning on/off of the LED on the keyboard 14, corresponding to the tone generation/tone deadening event is effected in consideration of only the song transposition value TP0 in the SONG buffer SB. Therefore, for the key depression guide purpose, there is no need to take into account the PANEL transposition value TP1 stored in the PANEL buffer PB.

More specifically, in a situation where the PANEL transposition value TP1 is set to "12" in the PANEL buffer PB and the SONG transposition value TP0 is set to "0" in the SONG buffer SB, a key-on event of "C3" read out from among the song data SD would represent a key-on event of "C4" in the automatic performance process; however, because the key to be depressed is also transposed in accordance with the PANEL transposition value TP1 in the PANEL buffer PB, a tone of "C4" can be actually designated by just instructing depression of the key at the "C3" location.

The tone generation/tone deadening process of step SP9 is carried out while the performance guide function is OFF (GUIDE=0), i.e., during normal tone generation of the automatic performance data. Specifically, at this step SP9, the tone pitch information changed earlier at step SP6 is further changed in accordance with the panel transposition value TP1 stored in the PANEL buffer PB and then sent to the tone generator device 9. More specifically, the event in the song data SD is subjected to a tone pitch conversion based on the two transposition values TP0 and TP1 stored in the SONG and PANEL buffers SB and PB. Namely, where the song and panel transposition values TP0 and TP1 are set to "2" and "12", respectively (i.e., TP0=2 and TP1=12), a tone pitch change amount of "2+12" (= one whole tone + one octave) is designated, so that the tone pitch information "C2" of the song data SD is changed to "D2" as shown by dotted line in FIG. 5.

Because the transposing operation of step SP6 is carried out during the automatic performance routine, the transposition can be changed during the course of the performance. However, the transposing operation of step SP6 may be carried out collectively for the entire performance data prior to the automatic performance, rather than during the course of the performance.

[Modifications]

The performance assistance technique of the present invention has been described so far in relation to the preferred embodiment, but it should be obvious that the present invention may be modified variously such as stated below. Whereas, in the described preferred embodiment, the tone pitches "A0" to "C8" are initially allocated to the 88 keys sequentially in the left-to-right direction of the keyboard, tone pitches "A1" to "C7" may be allocated to any other number of the keys than 88. Further, whereas the preferred embodiment has been described above as using LEDs as the performance guide (or key depression) display elements, keys to be depressed may be indicated using any other suitable lamps or other suitable key-displaying elements. In such a case, a picture of a keyboard may be displayed on a liquid crystal display or CRT so that each key to be depressed can be indicated via the corresponding key in the displayed picture or using a character, such as C4 or A4, instead of the actual key being indicated directly by the key-displaying element on the keyboard.

Furthermore, in the described preferred embodiment, the song transposition value TP0 is used as an addition of the panel transposition value TP1 (i.e., as a relative value), and the song data SD is sounded after being transposed in accordance with an absolute transposition value determined by combining the song and panel transposition values TPO and TP1. However, the present invention is of course not so limited. For example, the song data SD may be sounded after being transposed using only the song transposition value TP0 (as an absolute transposition value); more specifically, in this case, the transposition of the song data SD may be set in accordance with only the song transposition value TP0' with the panel transposition value TP1' used for transposition of the keyboard performance, and, for the performance guide purpose, each LED to be turned on/off may be determined on the basis of a difference between the song transposition value TP0' and the panel transposition value TP1' (TP0'−TP1').

To actually effect a transposition corresponding to the settings of FIG. 4, the user needs to set "+12" as the panel transposition value TP1' and "+14" as the song transposition value TP0. Then, on the basis of the difference between the song transposition value TP0' and the panel transposition value TP1' (TP0'−TP1'=+2), the user may determine a key to be visually indicated. Therefore, in the case where this alternative is employed, the difference between the song transposition value TP0' and the panel transposition value TP1' (TP0'−TP1') will be set as a transposition value relative to the automatic performance data alone or as a second transposition value.

Moreover, in the described preferred embodiment, transposition values are set by entering desired values via the numeric keypad(s). As a modification, musical keys to be transposed to may be shown on the display screen or there may be provided selection switches for the individual musical keys so that selecting a desired one of the musical keys by use of the screen or selection switch can cause transposition values to be arithmetically calculated for a desired transposition to the selected musical key. In another modification, transposition values for transposition to the individual musical keys may be prerecorded in templates in such a way that any one of the transposition values can be selectively read out in response to activation of a predetermined switch and then set in a predetermined manner. Further, the transposition values may be set by receiving transposition setting data from an external source, in which case the transposition setting device in the present invention may include arrangements for receiving the transposition setting data from the external source.

Whereas the preferred embodiment has been described above in relation to one-track automatic performance data, the present invention may use plural-track automatic performance data; in this case, the automatic performance data may have the data of the plural tracks organized either in a mixed fashion or in a non-mixed fashion. In the case where the plural-track automatic performance data are used, it is desirable that any desired one of the tracks be selectable as a subject for the performance or key depression guide by the LEDs, in which case the normal tone generation process is caused to be carried out for the other tracks that are not selected as the subject for the key depression guide.

Specifically, these track corresponding to a melody and an accompaniment are selected so that the performance data of the selected tracks are used as the automatic performance data. If the track corresponding to a melody is selected as the subject for the key depression guide, then the performance guide process will be performed on the basis of the melody track while the accompaniment track is subjected to the automatic performance process for automatic sounding.

Furthermore, the preferred embodiment has been described above in relation to the case where the composition or music piece data are in the "event plus absolute time" format where the time of occurrence of each performance event is represented by an absolute time within the music piece or a measure thereof. However, the present invention is not so limited, and the composition data used in the present invention may be in the "event plus relative time" format, the "pitch (rest) plus note length" format where each performance data is represented by a pitch and length of a note or a rest and a length of the rest, or the "solid" format where an LED performance guide region is reserved in memory for each minimum resolution of a performance and each performance event is stored in one of the memory regions that corresponds to the time of occurrence of the performance event.

It should also be obvious that the song data SD, namely, the automatic performance data, may be prestored in the RAM 4 or external storage device 10 rather than in the ROM 3. Further, the automatic performance data may be received from an external source via the communication interface 11 or not-shown MIDI interface.

Furthermore, although the preferred embodiment has been described above as arranged to not carry out the tone generation process on the automatic performance data when the performance guide is being provided, the automatic performance data may be sounded with a very small tone volume when the performance guide is being provided; such a performance guide with sounding in small tone volume can sometimes become some model performance or assistance to the manual performance practice. Moreover, whereas the preferred embodiment has been described above as using the performance guide function to advance the turning on/off of the LEDs sequentially in accordance with readout of the automatic performance data, a modification may be made such that the advance of the performance guide is temporarily stopped until the user or player hits a right key.

Moreover, although the present invention has been described above as a computer-based apparatus, the functions of the computer-based apparatus may be implemented by dedicated LSI circuitry, or by discrete circuits, including logic circuits, gate arrays, memory, etc. connected together. Also, a DSP may be used as necessary. Namely, the "processor" in the present invention is not limited to a general-purpose processor using a software tone generator, and may also be a hardware apparatus designed to perform functions dedicated to the present invention.

As has been described so far, the present invention is characterized in that, when the performance assistance is to be provided by visually indicating the keys to be depressed in accordance with progression of events read out from among the automatic performance data, a song transposition value is set only for an automatic performance (song data) and the tone pitch of each of the read-out events is changed on the basis of the thus-set song transposition value so that the key corresponding to the changed tone pitch is visually indicated and the tone pitch corresponding to the depressed key is sounded irrespective of the song transposition value. Further, according to the present invention, the song transposition value can be set independently of a panel transposition value that imparts a transposing function to the entire tone generation processing system.

With such characteristic arrangements of the present invention, the user or player is allowed to practice performance, as with a natural musical instrument such as a piano, under the visual performance guide by the LEDs or the like, through simple setting operations to set desired song transposition amounts and select a desired musical key. Further, it only suffices to pre-record a set of automatic performance data corresponding to a particular musical key, which can be used to provide a versatile key depression guide corresponding to a variety of musical keys without wasting data storage areas of limited capacity.

Further, in the present invention, the tone pitch of the automatic performance data, changed on the basis of the song transposition value for the key depression guide purpose, is additionally changed on the basis of the panel transposition value to sound the automatic performance data. This arrangement allows the transposed automatic performance to be listened to as in the conventional apparatus and also allows a model performance to be listened to when the key depression guide is being provided.

What is claimed is:

1. A music performance apparatus comprising:

a plurality of performance operators corresponding to a plurality of tone pitches;

a performance guide device adapted to provide a performance guide display for indicating which of said performance operators is to be operated;

a performance data supplying device adapted to supply performance data of an optionally selected music piece, said performance data containing at least tone pitch information, a transposition setting device adapted to set a transposition value for the performance data, wherein a user of the music performance apparatus utilizes the transposition setting device to set the transposition value;

a processor coupled with at least said performance guide device, said performance data supplying device and said transposition setting device, said processor being adapted to transpose the performance data by controlling the tone pitch information in accordance with the transposition value set by said transposition setting device and cause said performance guide device to provide the performance guide display based on the controlled tone pitch information, wherein the performance guide device is adapted to provide the performance guide display for the music performance apparatus for indicating which of said performance operators is to be operated, and wherein a transpose of the performance data is the same as the performance data or a variation of the performance data, wherein the variation differs from the performance data in terms of a musical key in which the performance data is stored;

a tone generator device adapted to generate a tone at least in response to operation of any of said performance operators, wherein the transposition value set by said transposition setting device is not applied to a tone that is to be generated via said tone generator device in response to the operation of said performance operator; and a general transposition setting device adapted to set a general transposition value wherein a pitch of the tone to be generated via said tone generator device in response to the operation of said performance operator is controlled in accordance with the general transposition value set by said general transposition setting device.

2. A music performance apparatus as claimed in claim 1 wherein said processor is adapted to advance an automatic performance based on the performance data supplied by said performance data supplying device, wherein the performance data is transposed sequentially as the automatic performance advances, in response to which is provided the performance guide display according to an advance of the automatic performance, and said tone generator device generates a tone corresponding to the operation of said performance operator but does not generate a tone corresponding to the automatic performance.

3. A music performance apparatus as claimed in claim 1 wherein said processor is adapted to advance an automatic performance based on the performance data supplied by said performance data supplying device, wherein the performance data is transposed sequentially as the automatic performance advances, in response to which is provided the performance guide display according to an advance of the automatic performance, and said tone generator device is capable of generating a tone corresponding to the automatic performance.

4. A music performance apparatus as claimed in claim 1 wherein said performance guide device includes a plurality of key-displaying elements provided in corresponding relation to said performance operators.

5. A music performance apparatus as claimed in claim 1 which further comprises a setting device for setting whether or not the performance guide display should be provided based on the performance data, and wherein when the performance guide display is being set by said setting device, said tone generator device does not generate a tone based on the performance data, but when the performance guide display is not being set by said setting device, a pitch of a tone corresponding to said performance data transposed by said processor is further controlled in accordance with the general transposition value set by said general transposition setting device and then said tone generator device generates a tone based on said performance data having the further controlled pitch.

6. A music performance apparatus comprising:

a plurality of performance operators corresponding to a plurality of tone pitches;

a performance guide device adapted to provide a performance guide display for indicating which of said performance operators is to be operated;

a performance data supplying device adapted to supply performance data of an optionally selected music piece, said performance data containing at least tone pitch information;

a transposition setting device adapted to set a transposition value for the performance data, wherein a user of the music performance apparatus utilizes the transposition setting device to set the transposition value;

a processor coupled with at least said performance guide device, said performance data supplying device and said transposition setting device, said processor being adapted to transpose the performance data by controlling the tone pitch information in accordance with the transposition value set by said transposition setting device and cause said performance guide device to provide the performance guide display based on the controlled tone pitch information, wherein the performance guide device is adapted to provide the performance guide display for the music performance apparatus for indicating which of said performance operators is to be operated, and wherein a transpose of the performance data is the same as the performance data or a variation of the performance data, wherein the variation differs from the performance data in terms of a musical key in which the performance data is stored;

a tone generator device adapted to generate a tone at least in response to operation of any of said performance operators, wherein the transposition value set by said transposition setting device is not applied to a tone that is to be generated via said tone generator device in response to the operation of said performance operator, said processor is adapted to advance an automatic performance on the basis of the performance data supplied by said performance data supplying device, the performance data is transposed sequentially as the automatic performance advances, in response to which is provided the performance guide display according to an advance of the automatic performance, and said tone generator device is capable of generating a tone corresponding to the automatic performance;

a general transposition setting device adapted to set a general transposition value, wherein a pitch of the tone to be generated via said tone generator device in response to the operation of said performance operator is controlled in accordance with the general transposition value set by said general transposition setting device, and a pitch of the tone corresponding to the automatic performance is controlled in accordance with a combination of the transposition value set by said transposition setting device for the performance data and the general transposition value set by said general transposition setting device.

7. A music performance apparatus as claimed in claim 6 wherein a pitch of the tone to be generated via said tone generator device in correspondence with the automatic performance is controlled in accordance with the transposition value set by said transposition setting device for the performance data, the apparatus further including a general transposition setting device adapted to set a general transposition value, a pitch of the tone to be generated via said tone generator device in response to the operation of said performance operator being controlled in accordance with the general transposition value set by said general transposition setting device, and wherein said processor transposes the performance data by controlling the tone pitch information in accordance with a difference between the transposition value set by said transposition setting device for the performance data and the general transposition value set by said general transposition setting device and causes said performance guide device to provide the performance guide display based on the controlled tone pitch information.

8. A method of providing a performance guide in a music performance apparatus which includes a plurality of performance operators corresponding to a plurality of tone pitches and a performance guide device for providing a performance guide display to indicate which of said performance operators is to be operated, said method comprising:

a step of supplying performance data of an optionally selected music piece, said performance data containing at least tone pitch information;

a step of setting a transposition value for the performance data;

a step of transposing the performance data by controlling the tone pitch information in accordance with the transposition value set by said step of setting, wherein a transpose of the performance data is the same as the performance data or a variation of the performance data, wherein the variation differs from the performance data in terms of a musical key in which the performance data is stored;

a step of causing said performance guide device to provide the performance guide display based on the controlled tone pitch information, wherein the performance guide device is adapted to provide the performance guide display indicating which of said performance operators is to be operated; and a step of generating a tone in response to operation of any of said performance operators, wherein the transposition value set by said step of setting is not applied to a tone that is to be generated in response to the operation of said performance operator, and a pitch of the tone to be generated in response to the operation of said performance operator is controlled in accordance with the transposition value.

9. The method of claim 8, further including:

a step of setting whether or not the performance guide display should be provided based on the performance data, wherein when the performance guide display is being set a tone is not generated based on the performance data, but when the performance guide display is not being set, a pitch of a tone corresponding to said performance data that is transposed is further controlled in accordance with a general transposition value; and a step of generating a tone based on said performance data having the further controlled pitch.

10. A machine-readable storage medium containing a group of instructions of a program executable by a processor for causing a performance guide device to provide a guide to a manual performance in a music performance apparatus which includes a plurality of performance operators corresponding to a plurality of tone pitches and a performance guide device for providing a performance guide display to indicate which of said performance operators is to be operated, said program comprising:

a step of supplying performance data of an optionally selected music piece, said performance data containing at least tone pitch information;

a step of setting a transposition value for the performance data;

a step of transposing the performance data by controlling the tone pitch information in accordance with the transposition value set by said step of setting, wherein a transpose of the performance data is the same as the performance data or a variation of the performance data, wherein the variation differs from the performance data in terms of a musical key in which the performance data is stored;

a step of causing said performance guide device to provide the performance guide display based on the controlled tone pitch information, wherein the performance guide device is adapted to provide the performance guide display for the music performance apparatus for indicating which of said performance operators is to be operated; and a step of generating a tone is response to operation of any of said performance operators, wherein the transposition value set by said step of setting is not applied to a tone that is to be generated in response to the operation of said performance operator, and a pitch of the tone to be generated in response to the operation of said performance operator is controlled in accordance with the transposition value.

11. The machine-readable storage medium of claim 10, wherein the program further includes:

a step of setting whether or not the performance guide display should be provided based on the performance data, wherein when the performance guide display is being set a tone is not generated based on the performance data, but when the performance guide display is not being set, a pitch of a tone corresponding to said performance data that is transposed is further controlled in accordance with a general transposition value; and a step of generating a tone based on said performance data having the further controlled pitch.

12. A method of providing a performance guide in a music performance apparatus which includes a plurality of performance operators corresponding to a plurality of tone pitches and a performance guide device for providing a performance guide display to indicate which of said performance operators is to be operated, said method comprising:

a step of supplying performance data of an optionally selected music piece, said performance data containing at least tone pitch information;

a step of setting a transposition value for the performance data;

a step of transposing the performance data by controlling the tone pitch information in accordance with the transposition value set by said step of setting, wherein a transpose of the performance data is the same as the performance data or a variation of the performance data, wherein the variation differs from the performance data in terms of a musical key in which the performance data is stored;

a step of causing said performance guide device to provide the performance guide display based on the controlled tone pitch information, wherein the performance guide device is adapted to provide the performance guide display indicating which of said performance operators is to be operated; and a step of generating a tone in response to operation of any of said performance operators, wherein the transposition value set by said step of setting is not applied to a tone that is to be generated in response to the operation of said performance operator, and a pitch of the tone to be generated in response to the operation of said performance operator is controlled in accordance with the transposition value;

a step of advancing an automatic performance based on the performance data supplied;

a step of transposing sequentially as the automatic performance advances, in response to which is provided the performance guide display according to an advance of the automatic performance; and a step of controlling a pitch of the tone corresponding to the automatic performance in accordance with a combination of the transposition value for the performance data and a general transposition value set.

13. The method of claim 12, further including:

a step of setting a device to determine whether or not the performance guide display should be provided based on the performance data, wherein when the performance guide display is being set a tone is not generated based on the performance data, but when the performance guide display is not being set a pitch of a tone corresponding to said performance data that is transposed is further controlled in accordance with a general transposition value; and a step of generating a tone based on said performance data having the further controlled pitch.

14. A machine-readable storage medium containing a group of instructions of a program executable by a processor for causing a performance guide device to provide a guide to a manual performance in a music performance apparatus which includes a plurality of performance operators corresponding to a plurality of tone pitches and a performance guide device for providing a performance guide display to indicate which of said performance operators is to be operated, said program comprising:

a step of supplying performance data of an optionally selected music piece, said performance data containing at least tone pitch information;

a step of setting a transposition value for the performance data;

a step of transposing the performance data by controlling the tone pitch information in accordance with the transposition value set by said step of setting, wherein a transpose of the performance data is the same as the performance data or a variation of the performance data, wherein the variation differs from the performance data in terms of a musical key in which the performance data is stored;

a step of causing said performance guide device to provide the performance guide display based on the controlled tone pitch information, wherein the performance guide device is adapted to provide the performance guide display for the music performance apparatus for indicating which of said performance operators is to be operated;

a step of generating a tone is response to operation of any of said performance operators;

a step of advancing an automatic performance based on the performance data supplied;

a step of transposing sequentially as the automatic performance advances, in response to which is provided the performance guide display according to an advance of the automatic performance; and a step of controlling a pitch of the tone corresponding to the automatic performance in accordance with a combination of the transposition value for the performance data and a general transposition value.

15. The machine-readable storage medium of claim 14, wherein the program further includes:

a step of setting whether or not the performance guide display should be provided based on the performance data, wherein when the performance guide display is being set a tone is not generated based on the performance data, but when the performance guide display is not being set, a pitch of a tone corresponding to said performance data that is transposed is further controlled in accordance with a general transposition value; and a step of generating a tone based on said performance data having the further controlled pitch.

* * * * *